US010830550B2

(12) United States Patent
Wolf et al.

(10) Patent No.: US 10,830,550 B2
(45) **Date of Patent: *Nov. 10, 2020**

(54) FIREARM ACCESSORY MOUNTING SYSTEM

(71) Applicant: ZEV Technologies, Inc., Oxnard, CA (US)

(72) Inventors: Alec Daniel Wolf, Santa Monica, CA (US); Sheehan Hsu, Pasadena, CA (US)

(73) Assignee: ZEV Technologies, Inc., Oxnard, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/575,702

(22) Filed: Sep. 19, 2019

(65) Prior Publication Data

US 2020/0173752 A1 Jun. 4, 2020

Related U.S. Application Data

(62) Division of application No. 15/407,168, filed on Jan. 16, 2017.

(60) Provisional application No. 62/279,556, filed on Jan. 15, 2016.

(51) Int. Cl.

| | |
|---|---|
| ***F41A 21/32*** | (2006.01) |
| *F41A 21/36* | (2006.01) |
| *F41A 21/34* | (2006.01) |
| *F41A 21/30* | (2006.01) |

(52) U.S. Cl.

CPC ..... *F41A 21/325* (2013.01); *F41A 21/30* (2013.01); *F41A 21/34* (2013.01); *F41A 21/36* (2013.01)

(58) Field of Classification Search

CPC ..... F41A 21/32; F41A 21/325; F41A 21/30; F41A 21/34; F41A 21/36; F41A 21/48; F41A 21/481

See application file for complete search history.

(56) References Cited

U.S. PATENT DOCUMENTS

| | | | | | |
|---|---|---|---|---|---|
| 37,193 | A | * | 12/1862 | Alsop | F41A 21/325 42/78 |
| 428,458 | A | | 5/1890 | Cochran et al. | |
| 529,455 | A | * | 11/1894 | Marlin | F41A 21/481 42/75.02 |
| 618,033 | A | | 1/1899 | Hemming | |
| 968,583 | A | * | 8/1910 | Michaud | F41A 21/40 42/79 |
| 1,257,713 | A | | 2/1918 | Johnson | |
| 1,427,802 | A | * | 9/1922 | Goodwin | F41A 21/30 181/223 |

(Continued)

OTHER PUBLICATIONS

Yam, Hilton, M&P C.O.R.E.: Mounting the Optic, First Look: S&W M&P Core; Modern Service Weapons; http://modernserviceweapons.com/?=1289; http://modernserviceweapons.com/?p=1474; Nov. 30, 2012, Dec. 13, 2012.

*Primary Examiner* — Derrick R Morgan
(74) *Attorney, Agent, or Firm* — Wood Herron & Evans LLP

(57) ABSTRACT

An adaptor for mounting the firearm accessory to a barrel of a firearm. The adaptor may include an indexing component that aligns the accessory into a desired orientation. The adaptor may include a threaded interconnection as well as a spring biased interconnection.

17 Claims, 6 Drawing Sheets

(56) References Cited

U.S. PATENT DOCUMENTS 1,455,661 A * 5/1923 Rhinehart ..... F41A 21/40 42/79
2,030,312 A 2/1936 Mossberg
2,079,266 A 5/1937 Vaver
2,153,246 A * 4/1939 Gibson ..... F41A 21/42 42/79
2,162,090 A 6/1939 King
2,438,601 A 3/1948 Davis
2,465,561 A 3/1949 Wilson
2,976,638 A * 3/1961 Owens ..... F41C 3/14 42/77
3,193,932 A 7/1965 Johnson
3,199,202 A 8/1965 Williams
3,409,232 A 11/1968 Cholin
3,838,522 A 10/1974 Williams
4,008,536 A 2/1977 Adams
4,008,538 A * 2/1977 Center ..... F41A 21/28 42/78
4,015,354 A 4/1977 Brouthers
4,058,925 A * 11/1977 Linde ..... F41A 21/40 42/79
4,386,477 A * 6/1983 Briley ..... F41A 21/40 42/79
4,408,410 A * 10/1983 A'Costa ..... F41A 21/00 42/90
4,467,546 A * 8/1984 Beretta ..... F41A 21/40 42/79
D279,812 S 7/1985 Cellini
4,628,611 A 12/1986 Ruffino
4,674,217 A * 6/1987 Matievich ..... F41A 21/482 42/75.02
4,833,808 A 5/1989 Strahan
4,893,426 A * 1/1990 Bixler ..... F16B 7/20 403/299
5,050,480 A * 9/1991 Knight, Jr. ..... F41A 5/06 42/7
5,208,407 A 5/1993 Stover
5,271,312 A * 12/1993 Lishness ..... F41A 21/484 42/76.01
D343,222 S 1/1994 Morales
5,275,084 A 1/1994 Ruger
5,317,825 A * 6/1994 Vatterott ..... F41A 21/40 42/79
5,325,617 A * 7/1994 Vojta ..... F41A 11/02 42/75.03
5,388,335 A 2/1995 Jung
5,433,133 A * 7/1995 La France ..... F41A 21/325 89/14.2
5,481,818 A 1/1996 Stover
5,559,302 A * 9/1996 Latka ..... F41A 21/325 89/14.05
5,851,035 A * 12/1998 Marc ..... F16L 19/005 285/86
6,266,908 B1 * 7/2001 Spencer ..... F41A 21/485 42/71.02
6,327,806 B1 12/2001 Paige
6,655,372 B1 * 12/2003 Field ..... F41A 21/484 124/83
6,990,764 B2 * 1/2006 Walker ..... F41A 21/40 42/76.01
7,013,592 B2 3/2006 Olson et al.
7,032,341 B1 4/2006 Sconce et al.
7,076,904 B1 * 7/2006 Rustick ..... F41A 21/482 42/75.01
7,254,913 B2 * 8/2007 Dubois ..... F41A 3/74 42/1.07
7,353,740 B1 4/2008 Hoffman
7,610,710 B2 * 11/2009 Brittingham ..... F41A 21/325 181/223
7,634,866 B2 12/2009 Javorsky
7,730,655 B2 6/2010 SpuShr
7,748,306 B1 * 7/2010 Curry ..... F41A 21/28 42/1.06
7,789,009 B1 * 9/2010 Brittingham ..... F41A 21/325 181/223
8,061,255 B1 11/2011 Boberg
8,087,194 B1 * 1/2012 Vuksanovich ..... F41A 21/48 42/75.01
8,096,073 B2 1/2012 Vielbig
8,117,780 B2 2/2012 Matthews et al.
8,701,326 B2 * 4/2014 Zonshine ..... F41A 21/10 42/77
8,714,300 B2 * 5/2014 Johansen ..... F41A 21/325 181/223
8,893,422 B2 11/2014 Wolf
8,997,621 B1 * 4/2015 Dater ..... F41A 21/325 89/14.3
9,057,576 B2 * 6/2015 Barrett ..... F41A 3/66
9,062,936 B2 6/2015 Zimmer
9,175,919 B2 11/2015 Russell et al.
9,377,263 B1 6/2016 Sy
9,383,155 B2 * 7/2016 Bero ..... F41A 3/66
9,513,078 B1 * 12/2016 Fulton ..... F41A 21/30
9,631,888 B2 * 4/2017 Young ..... F41A 21/325
D834,679 S 11/2018 Garcia, Jr.
10,184,744 B2 * 1/2019 Young ..... F41A 21/325
10,184,745 B1 * 1/2019 Fulton ..... F41A 21/30
10,612,878 B1 * 4/2020 Salvador ..... F41A 21/36
2006/0064914 A1 3/2006 Greer
2006/0207157 A1 9/2006 Keng
2007/0199227 A1 8/2007 Ertl
2008/0092424 A1 4/2008 Keng
2008/0173166 A1 7/2008 Andry
2008/0244953 A1 10/2008 Kilic
2010/0154273 A1 6/2010 Lippard
2010/0229712 A1 * 9/2010 Graham ..... F41A 21/325 89/14.2
2011/0036233 A1 * 2/2011 DeGroat ..... F41A 21/325 89/14.4
2011/0197487 A1 * 8/2011 Humston ..... F41A 21/34 42/1.06
2012/0090588 A1 * 4/2012 Chen ..... F41A 21/48 124/83
2012/0110886 A1 5/2012 Moore et al.
2012/0131835 A1 * 5/2012 Barrett ..... F41A 21/481 42/75.02
2013/0133976 A1 * 5/2013 Johansen ..... F41A 21/325 181/223
2013/0263492 A1 10/2013 Erdle
2013/0283659 A1 10/2013 Trapp et al.
2013/0283660 A1 10/2013 Matthews et al.
2014/0109456 A1 4/2014 Jung et al.
2014/0150318 A1 6/2014 Engesser et al.
2014/0165442 A1 6/2014 Nebeker et al.
2015/0198421 A1 7/2015 Crispin
2015/0253098 A1 * 9/2015 Russell ..... F41A 21/30 89/14.4
2016/0161203 A1 * 6/2016 Wilson ..... B23K 35/304 89/14.3
2017/0205176 A1 * 7/2017 Whitson ..... F41A 21/325
2018/0245872 A1 * 8/2018 Jen ..... F41A 21/325
2018/0292164 A1 * 10/2018 Thompson ..... F41A 21/325
2019/0093974 A1 3/2019 Smith
2019/0113296 A1 * 4/2019 McRorey ..... F41A 21/325
2020/0173752 A1 * 6/2020 Wolf ..... F41A 21/325

* cited by examiner

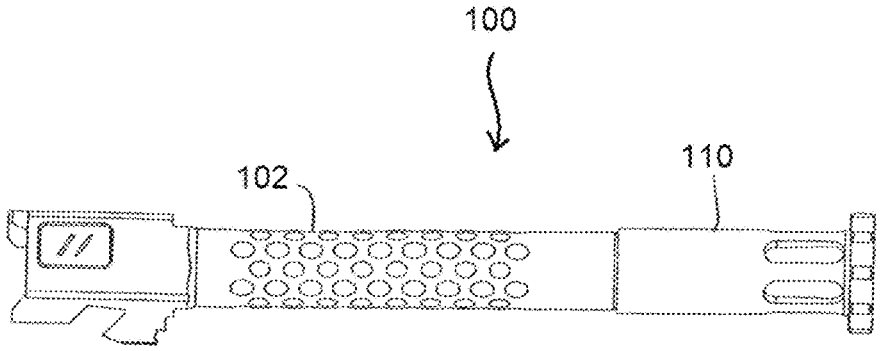
Fig. 1A
Fig. 1C
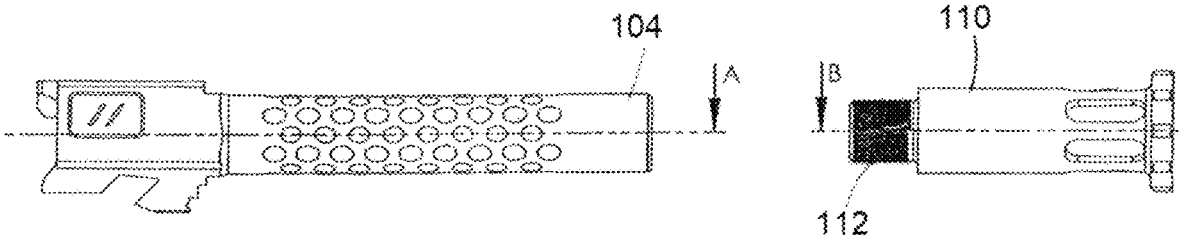
Fig. 1B
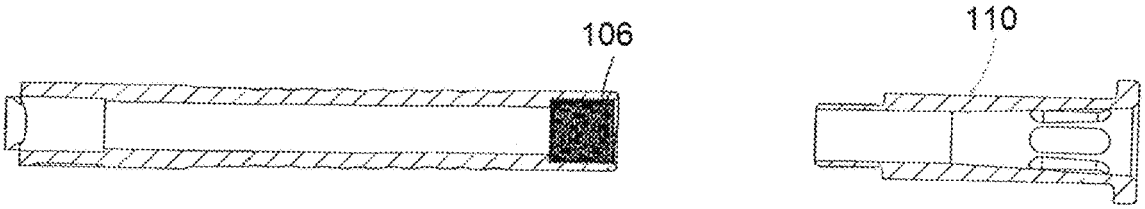

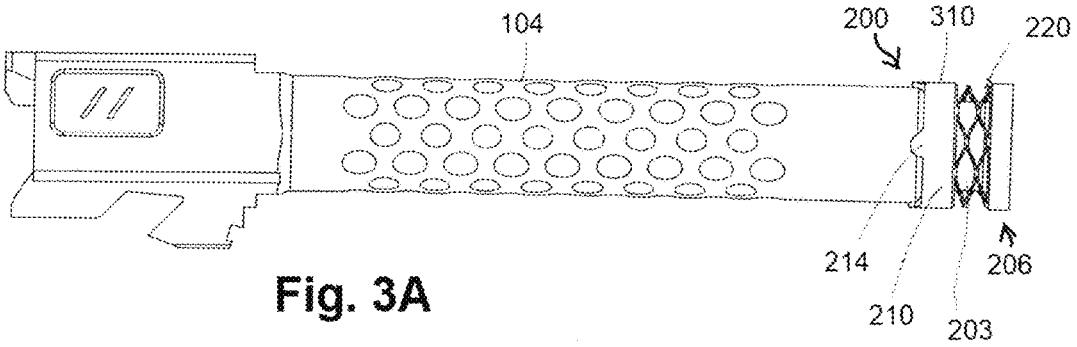
Fig. 3A
Fig. 3B
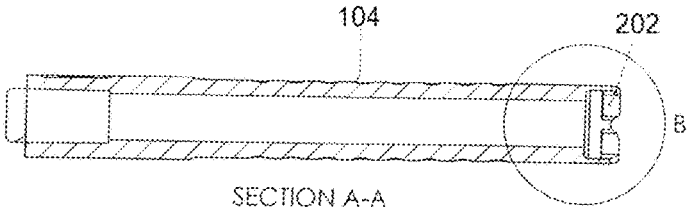
Fig. 3C
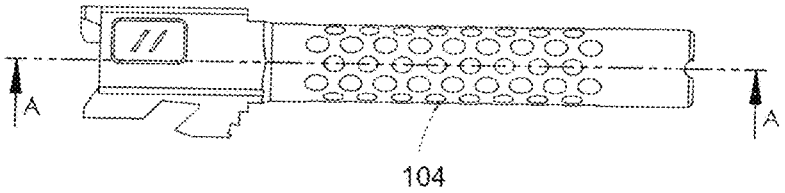
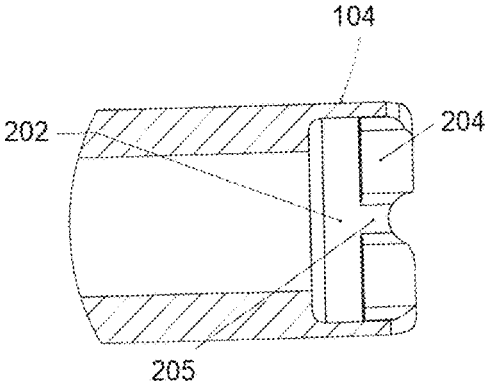
Fig. 3D
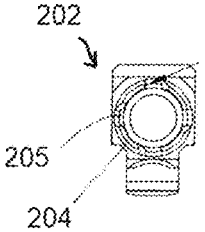
Fig. 3E

FIREARM ACCESSORY MOUNTING SYSTEM

CROSS-REFERENCE TO RELATED APPLICATIONS

This application is a divisional of U.S. patent application Ser. No. 15/407,168, titled FIREARM ACCESSORY MOUNTING SYSTEM, filed Jan. 16, 2017, which claims the benefit of U.S. Provisional Application No. 62/279,556, titled FIREARM ACCESSORY MOUNTING SYSTEM, filed Jan. 15, 2016. Each of the foregoing applications is hereby incorporated by reference herein in its entirety.

BACKGROUND OF THE INVENTION

Field of the Invention

The present invention relates to firearms and, in particular, concerns mounting accessories on the barrel of firearms such as semi-automatic pistols.

Description of the Related Art

Firearms can have accessories mounted on the front of the barrel that provide a variety of different functions for the firearm. For example, silencers can be added to the end of the barrel for reducing the audio report of the firearm. Flash suppressors can also be added for reducing the visibility of a muzzle flash when shooting in low or no light conditions. Compensators and muzzle breaks that engage with the high pressure gasses to alter the recoil characteristics of a firearm are also commonly used.

For example, recoil often causes the tip of the barrel to flip upwards in response to a shot being fired. This results in the firearm no longer being sighted in the general direction of the target. For example, with fast firing pistols, such as semiautomatic pistols, the advantages of being able to fire multiple shots quickly may be significantly reduced by the shooter having to re-align the firearm with the target after the muzzle of the barrel has flipped upwards in response to the firing of the pistol.

Compensators can be added to firearms that engage with the high pressure gasses travelling down the barrel in response to a shot being fired. Typically, there are vent ports that vent a portion of these gasses outward and the gasses engage with the ports to induce a force on the pistol that is preferably opposite the force of the recoil to reduce the recoil. For example, a compensator may have ports on the upper surface that the vented gasses induce a downward force opposite of the upward muzzle flip force.

Mounting of accessories such as silencers, flash suppressors, muzzle breaks and compensators typically require that the outside of the barrel be machined to receive the accessory. Often this requires the barrel be threaded which can be expensive and complicated. Moreover, in many applications, external threading requires the replacement of the existing barrel with a longer barrel that will have the material to include the external threads. This requires a substantial expenditure to purchase a complete new barrel.

Hence, there is a need for an accessory mounting system that facilitates mounting of accessories on the ends of barrels of firearms and, in particular on the ends of barrels of semiautomatic pistols.

SUMMARY OF THE INVENTION

The aforementioned needs are satisfied in one non-limiting example by a mounting system for firearm accessories that mounts to an interior portion of a barrel of the firearm. In one implementation, there is a threaded interconnection between the accessory and the barrel of the firearm. In this implementation, the muzzle end of the barrel is threaded on an inner surface with female threads and the accessory has a male threaded portion that engages with the female threaded portion inside of the barrel.

This implementation may also include an indexing feature that is interposed between a surface of the barrel and the accessory so that the accessory is maintained at a desired rotational position with respect to the barrel. When the accessory is an item such as a compensator, the indexing feature is designed to ensure that the vent openings are facing in a desired direction.

In another implementation, the inside of the end of the barrel is adapted to receive an insert that has lugs that engage with matching lugs on an adaptor base that is threaded or otherwise adapted to receive the accessory. In this implementation, there is also a locking jam that engages with the outside of the barrel and the adaptor base via a tensioning spring. The adaptor base is positioned so that the lugs of the adaptor base are positioned interior to the lugs on the insert via rotation of the adaptor base. The tensioning spring then urges against the locking jam and a lip of the adaptor base to retain the locking jam and the insert in the end of the barrel and to keep the lugs of the adaptor base engaged with the lugs of the barrel insert. The assembly can be removed by relieving the tension or bias of the spring, move the locking jam off the barrel and rotate the adaptor base. The locking jam can be leveraged as a tool that facilitates manual interaction with the spring by providing a handling surface to usher the spring's travel while simultaneously retreating from the barrel face itself and completing the step of moving the locking jab off the barrel.

In this way, accessories can be mounted to the end of a barrel without significantly affecting the outer surface of the barrel which can disrupt performance of firearms with slides that also engage the outer surface of the barrel. These and other objects and advantages of the present invention will become more apparent from the following description taken in conjunction with the accompanying drawings.

BRIEF DESCRIPTION OF THE DRAWINGS

FIGS. 1A-1C are side and cross sectional views of a first embodiment of an adaptor assembly for mounting accessories on a barrel of a firearm;

FIG. 3A-3E are side, front and cross sectional views of a barrel with a second embodiment of an adaptor assemblies;

DETAILED DESCRIPTION OF THE PREFERRED EMBODIMENT

Figure 1D:
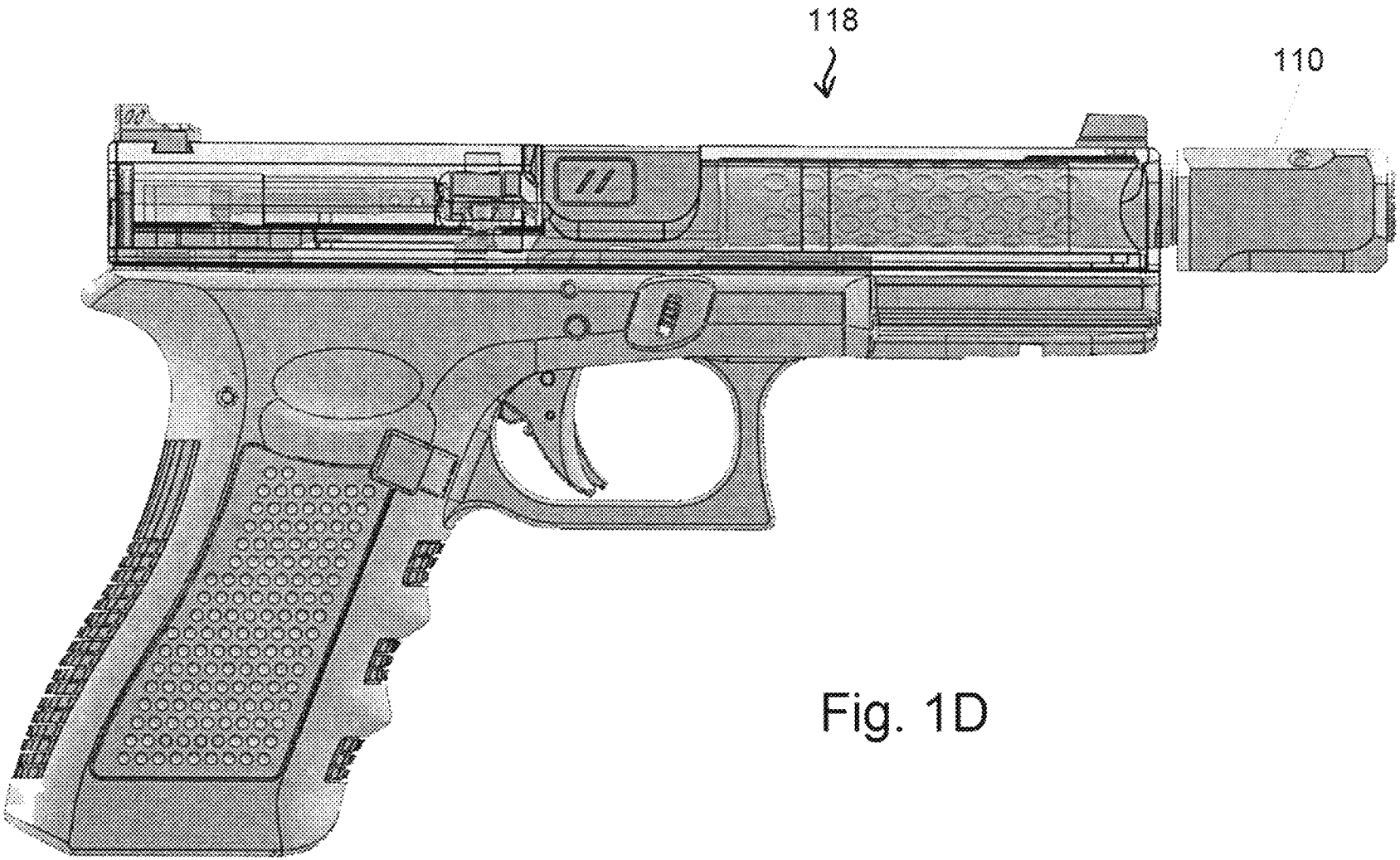
FIG. 1D is a side view of the adaptor of FIGS. 1A-1C being mounted on a firearm.

Reference will now be made to the drawings wherein like numerals refer to like parts throughout. Referring to FIGS. 1A-1D a first embodiment of an adaptor assembly 100 is disclosed. As shown, there is a barrel 102 of a firearm 100 (FIG. 1C) that has an outer or muzzle end 104 that is threaded 106 on the interior portion (FIG. 1B). The barrel 102 can comprise a typical barrel for a semi-automatic handgun 118 (FIG. 1D) such as a Glock™ handgun.

An accessory 110 has a male threaded portion 112 that engages with the threaded portion 106 of the barrel so as to be screwed into the barrel in the manner shown in FIG. 1A. As shown in FIG. 1B, the axis of the threaded accessory or auxiliary device 110 B is aligned with the axis A of the barrel 102 so that the projectile fired by the firearm travels through an opening of the accessory 110 that is aligned with the opening of the barrel. The accessory 110 can include any of a number of firearm accessories including, without limitation, flash suppressors, silencers, muzzle brakes, compensators and the like.

Figure 2A:
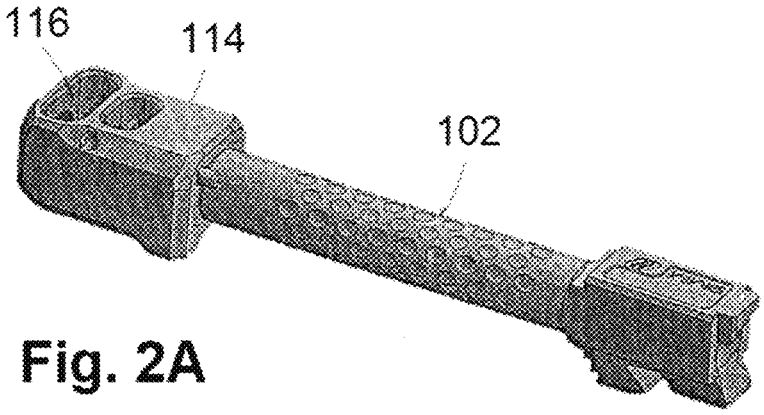
FIGS. 2A-2D are perspective views of an indexing system that can be used with the adaptor assembly disclosed herein.
Figure 2B:
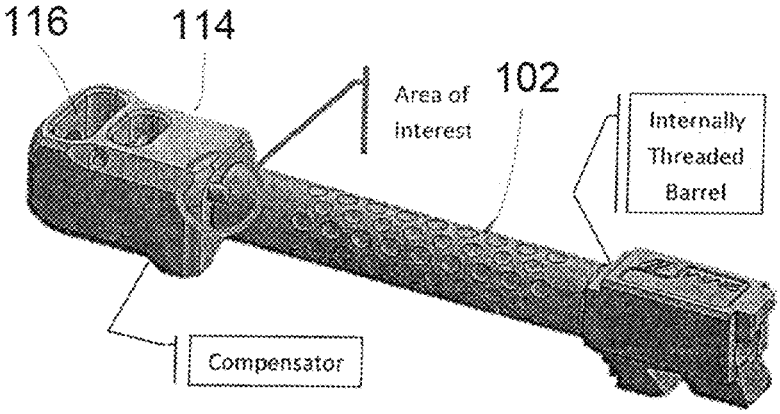
Figure 2C:
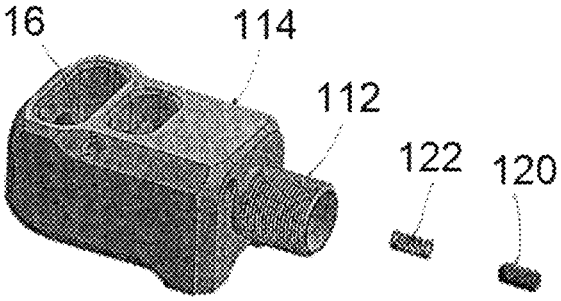
Figure 2D:
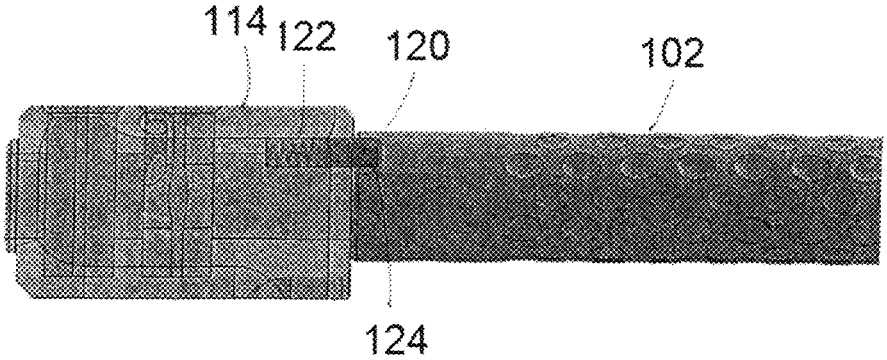

In some implementations, the accessory 110 will have a desired rotational orientation with respect to the barrel 102. For example, it may be desirable for a compensator 114 (FIGS. 2A-2D) be mounted so that the openings 116 face in a direction to vent gasses in opposition to the recoil of the firearm. To achieve this, the accessory 110 may include an alignment mechanism. In one instance shown in FIGS. 2C and 2D, the alignment mechanism is detent 120 that is biased by a spring 122 that is positioned in an opening 126 on the accessory 110. The detent is preferably positioned within a groove 124 formed in a desired location within the outer surface of the barrel 102 such that when the detent 120 is positioned within the groove 124, the accessory 110 is properly rotationally aligned with the barrel 102. The groove 124 can be relatively small so as to not affect the engagement of the barrel 102 with a slide on, for example, a semiautomatic handgun.

It will be appreciated that the positioning of the detent and groove can be reversed without departing from the spirit or scope of the present teachings. With the implementation of a compensator 114, the detent is located so that the exhaust openings 116 of the compensator are located so as to vent high pressure gasses upwards upon the firing of the pistol so as to counteract the tendency of the pistol to rotate when fired.

Still further in another implementation, the groove 124 in the barrel is defined to be a notch that is exposed on an outer surface of the barrel 110. It will be appreciated that the compensator 114 will have to be rotated multiple times until it is fully threaded onto the barrel 102 so the user will have to depress the detent 120 to permit the compensator 114 to be rotated another rotation. By forming a notch, the detent will be exposed permitting the user to depress the detent to permit further rotation and also to permit removal of the compensator from the barrel of the firearm.

FIGS. 3A-3F and 4A-4C illustrate another embodiment of an accessory mounting system 200 that mounts accessories such as those described above to the end of a barrel 102. In this embodiment, the barrel 102 is shaped to receive an insert 202 at the outer or muzzle end 104 of the barrel. The insert 202 includes barrel lugs 204 and one or more inlets 205 that will engage with lugs 208 on a modular adaptor base 206 in a manner that will be described in greater detail herein below. The insert 202 can be either separate or integrally formed on the barrel 102.

Figure 3F:
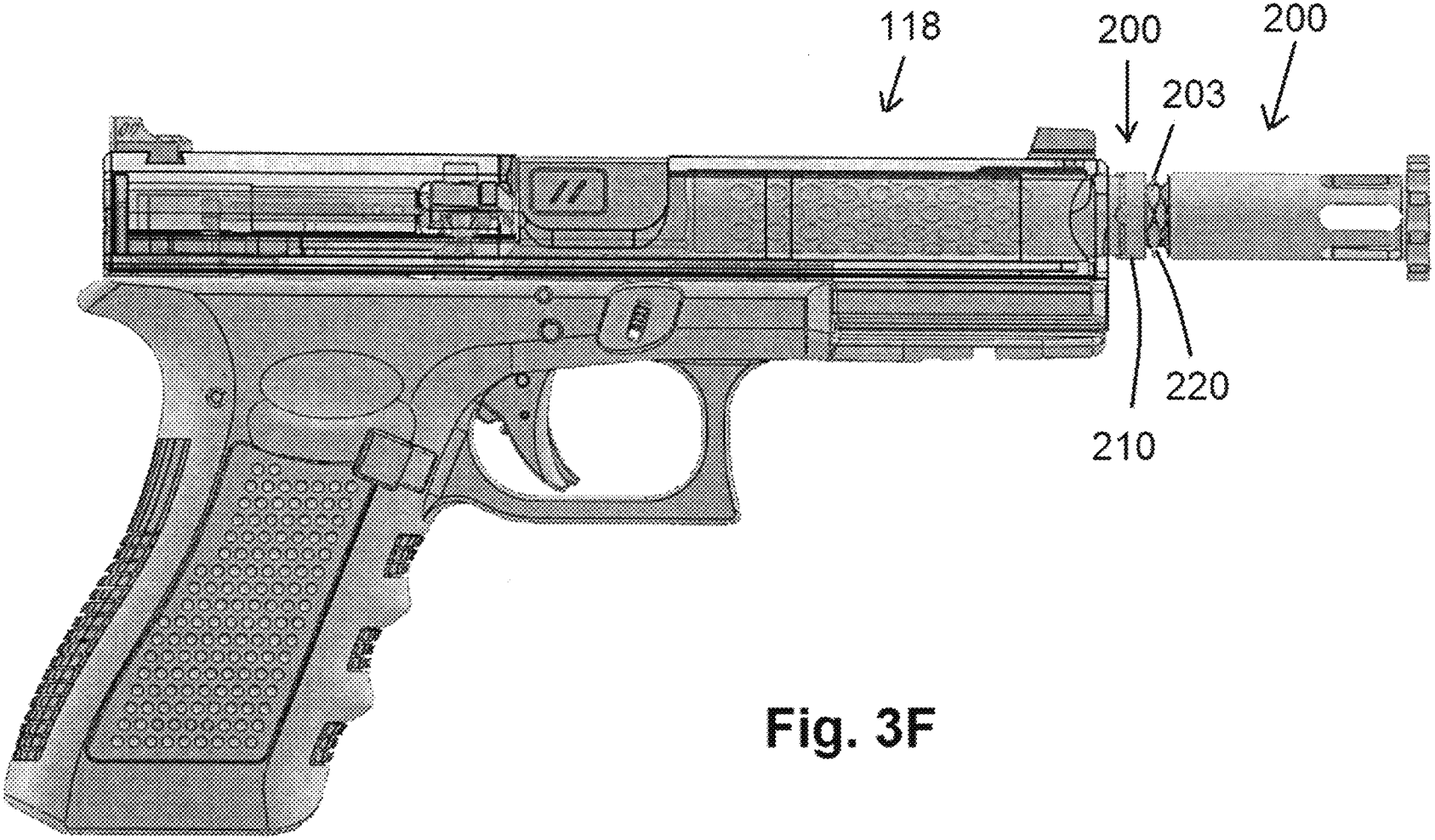
FIG. 3F is a side view of the adaptor of FIGS. 3A-3D mounted on a firearm.

As shown in FIGS. 3A and 3D, the insert 202 comprises an annular ring that is positioned at the outer end of the barrel 104. As will be discussed below, the lugs 208 on the modular adaptor base 206 are inserted through the inlets 205 and then twisted so that the lugs 208 of the adaptor base 206 are positioned behind the lugs 204 of the insert 202. As shown in FIG. 3E, the lugs 204 are sized so as to be positioned away from the center of the barrel 104 and the flight path of a projectile fired by the gun 119 (FIG. 3F).

The assembly 200 also includes a locking jam 210 (FIGS. 3A and 4A) that has flutes 212 that allow clearance for the assembly onto the modular adaptor base. The locking jam 210 is an annular member that defines an opening 211 that receives the outer surface of the barrel 104. The flutes 212 may also engage with protrusions formed on the outer surface of the adaptor base 206 such that the protrusions can extend through the flutes so that teeth 214 can interact with the complementary points on the firearm barrel to index and orient the assembly 200 via rotation of the locking jam 210. The complementary points may be either protrusions or indentations without limitation.

Figure 4A:
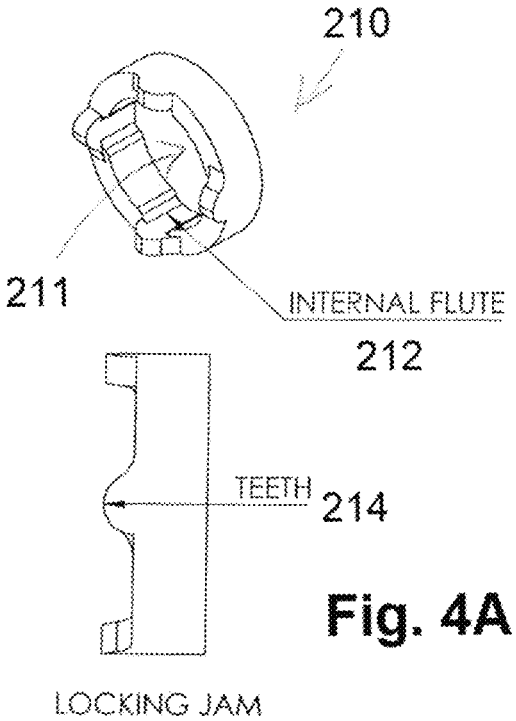
FIG. 4A-4C are side and perspective views of various component parts of the adaptor assembly of FIGS. 3A-3F.
Figure 4B:
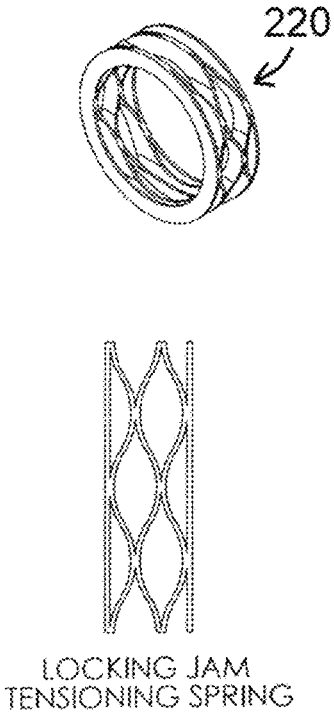
Figure 4C:
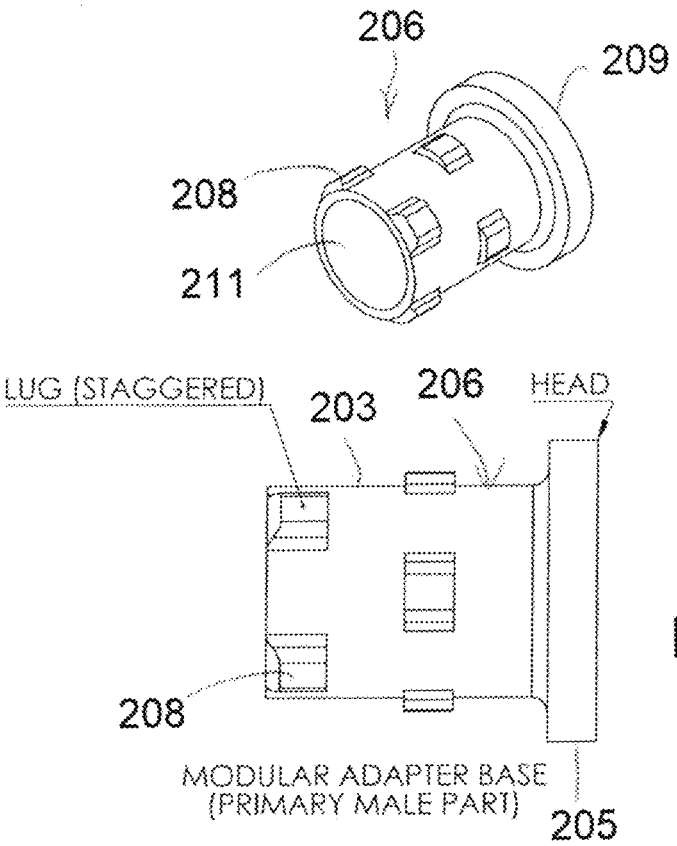

As shown in FIGS. 3A and 4C, the adaptor 200 includes a modular adaptor base 206 that comprises a cylindrical structure with lugs 208 formed at regular intervals along the outer surface. As shown, there are two rows of lugs 208 that are offset from each other. The modular adaptor base 206 also includes a head 209 that defines an opening 211 that can be threaded to receive an accessory component such as a compensator, flash suppressor, silencer etc.

The modular adaptor base 206 is inserted into the insert 202 (FIG. 3A) such that the lugs 208 extend through the inlets 205 on the insert 202 (FIG. 3D) and the modular adaptor base 206 can then be rotated so that the lugs 208 engage with the barrel lugs 204 to retain the modular adaptor base 206.

A locking spring 220 (FIGS. 3A and 4B) is positioned about a shaft 203 of the adaptor base 206 so as to be interposed between the locking jam 210 and the lip 205 of the adaptor base 206 to enhance engagement of the adaptor base lugs with the barrel lugs and to help to retain the locking jam 210 on the barrel. The spring 220 biases the adaptor base 208 outward to frictionally engage the outer surface of the lugs 208 with the inner surface of the lugs 205 of the adapter insert 202.

The modular adaptor base 206 is preferably threaded or otherwise contoured on an interior surface so as to receive a mating element of an accessory in the manner shown in FIG. 3F. This embodiment is easily removable from the barrel 102. It will also be appreciated that the indexing system described in conjunction with FIGS. 2A-2D can also be used on the instant embodiment without departing from the spirit or scope of the instant teachings.

The foregoing description has shown, illustrated and described various implementations and embodiments of the present teachings. However, it will be appreciated that various substitutions, changes and modifications of the foregoing teachings can be made by those skilled in the art without departing from the spirit or scope of the present teachings. Consequently, the present teachings should not be limited to the foregoing discussion but should be defined by the appended claims.

What is claimed is:

1. An adaptor system for mounting an accessory to a firearm, the adaptor system comprising:

a firearm barrel comprising a bore and a muzzle end, the bore comprising a first diameter sized for a projectile to be fired therethrough, the muzzle end comprising an opening through which the projectile may be ejected, wherein an interior of the muzzle end comprises:

a first plurality of lugs extending radially inwardly adjacent the opening;

a plurality of slots interposed between the first plurality of lugs; and an annular groove positioned behind the first plurality of lugs;

an adaptor comprising a longitudinally extending shaft and a second plurality of lugs, the second plurality of lugs extending radially outwardly from the shaft and sized to be inserted longitudinally through the plurality of slots of the muzzle end of the firearm barrel, wherein the shaft of the adapter is rotatable within the interior of the muzzle end of the firearm barrel such that at least a portion of the second plurality of lugs can be positioned within the annular groove, with a forward portion of the second plurality of lugs being in contact with a rearward portion of the first plurality of lugs; and a biasing member positioned to bias the adapter in a longitudinal direction away from the bore of the firearm barrel, such that the forward portion of the second plurality of lugs will remain in contact with the rearward portion of the first plurality of lugs.

2. The adapter system of claim 1, wherein the biasing member comprises an annular spring.

3. The adapter system of claim 2, wherein the annular spring is positioned about the shaft of the adapter.

4. The adapter system of claim 3, wherein the annular spring is positioned longitudinally between the second plurality of lugs and a flange of the adapter.

5. The adapter system of claim 1, further comprising a locking jam configured to maintain the adapter in a rotational orientation with respect to the barrel, the locking jam comprising:

at least one internal flute shaped to engage a protrusion that protrudes radially from the shaft of the adapter; and at least one longitudinally protruding member shaped to engage a longitudinally recessed portion of the muzzle end of the firearm barrel.

6. The adapter system of claim 5, wherein the biasing member comprises an annular spring positioned about the shaft of the adapter.

7. The adapter system of claim 6, wherein the annular spring is positioned longitudinally between the locking jam and a flange of the adapter.

8. The adapter system of claim 1, wherein the adapter further comprises a mounting component configured to receive an accessory.

9. The adapter system of claim 8, wherein the mounting component comprises a thread configured to receive a threaded portion of the accessory.

10. The adapter system of claim 1, wherein the adapter further comprises an accessory comprising at least one of the following: a compensator, a silencer, or a flash suppressor.

11. The adapter system of claim 1, wherein the firearm barrel further comprises a chamber end positioned at an opposite end from the muzzle end, the chamber end comprising a cavity sized for positioning therein of a projectile cartridge.

12. The adapter system of claim 1, wherein an innermost surface of the first plurality of lugs defines a second diameter that is larger than the first diameter of the bore of the firearm barrel.

13. A firearm barrel for use in a quick release accessory adapter system, the firearm barrel comprising:

a bore comprising a diameter sized for a projectile to be fired therethrough; and a muzzle end comprising an opening through which the projectile may be ejected, wherein an interior of the muzzle end comprises:

a plurality of lugs extending radially inwardly adjacent the opening;

a plurality of slots interposed between the plurality of lugs; and a radially outwardly extending annular groove positioned behind the plurality of lugs, for positioning of complementary lugs of a component separable from the firearm barrel, and wherein a forward-most face of the muzzle end further comprises at least one longitudinally recessed or protruding portion for engaging a complementary portion of a locking jam to rotationally orient the locking jam with respect to the muzzle end.

14. The firearm barrel of claim 13, wherein the at least one longitudinally recessed or protruding portion of the muzzle end comprises a recess that extends rearward from the forward-most face of the muzzle end of the firearm barrel.

15. The firearm barrel of claim 13, wherein the at least one longitudinally recessed or protruding portion of the muzzle end comprises a plurality of longitudinally recessed portions spaced about the forward-most face of the muzzle end.

16. The firearm barrel of claim 13, wherein the radially outwardly extending groove comprises an annular groove comprising a diameter that is larger than the diameter of the bore.

17. The firearm barrel of claim 13, further comprising a chamber end positioned at an opposite end from the muzzle end, the chamber end comprising a cavity sized for positioning therein of a projectile cartridge.

* * * * *